US007293423B2

(12) United States Patent
Upadhya et al.

(10) Patent No.: US 7,293,423 B2
(45) Date of Patent: Nov. 13, 2007

(54) METHOD AND APPARATUS FOR CONTROLLING FREEZING NUCLEATION AND PROPAGATION

(75) Inventors: Girish Upadhya, Cupertino, CA (US); Richard Grant Brewer, Newark, CA (US); Mark McMaster, Menlo Park, CA (US)

(73) Assignee: Cooligy Inc., Mountain View, CA (US)

( * ) Notice: Subject to any disclaimer, the term of this patent is extended or adjusted under 35 U.S.C. 154(b) by 268 days.

(21) Appl. No.: 11/049,202

(22) Filed: Feb. 1, 2005

(65) Prior Publication Data

US 2005/0268626 A1 Dec. 8, 2005

Related U.S. Application Data

(60) Provisional application No. 60/577,262, filed on Jun. 4, 2004.

(51) Int. Cl.
*F25D 21/00* (2006.01)

(52) U.S. Cl. ..... 62/150; 62/532; 62/272; 165/81; 165/146; 165/147

(58) Field of Classification Search ..... 62/80, 62/140, 150, 272, 132, 532; 165/81, 82, 165/83, 146, 147
See application file for complete search history.

(56) References Cited

U.S. PATENT DOCUMENTS 596,062 A 12/1897 Firey
2,039,593 A 5/1936 Hubbuch et al.
2,273,505 A 2/1942 Florian
3,267,859 A 8/1966 Jutila
3,361,195 A 1/1968 Meyerhoff et al.

(Continued)

FOREIGN PATENT DOCUMENTS

CN 97212126.9 3/1997

(Continued)

OTHER PUBLICATIONS

Stephen C. Jacobson et al., "Fused Quartz Substrates for Microchip Electrophoresis", Analytical Chemistry, vol. 67, No. 13, Jul. 1, 1995, pp. 2059-2063.

(Continued)

*Primary Examiner*—Marc Norman
(74) *Attorney, Agent, or Firm*—Haverstock & Owens LLP.

(57) ABSTRACT

An apparatus and method of controlling freezing in a liquid system is disclosed. The apparatus includes a heat exchanger having a initial zone characterized by a surface area to volume ratio. The apparatus also includes means for initiating freezing of a fluid from the initial zone to facilitate volume expansion during freezing in the direction of a final zone characterized by a final zone surface area to volume ratio. The apparatus can further include a plurality of zones located between the initial zone and the final zone, wherein a zone surface area to volume ratio is calculated for each zone. Preferably, the zone surface area to volume ratio of each zone progressively decreases from the initial zone in the direction of the final zone. Preferably, the final freezing zone has the lowest surface area to volume ratio and has sufficient elasticity to accommodate the volume expansion of all the fluid that has frozen from the initial zone.

52 Claims, 2 Drawing Sheets

U.S. PATENT DOCUMENTS

| | | | | | |
|---|---|---|---|---|---|
| 3,554,669 | A | | 1/1971 | Reader | |
| 3,635,727 | A | * | 1/1972 | Ehrgott | 426/385 |
| 3,654,988 | A | | 4/1972 | Clayton, III | |
| 3,771,219 | A | | 11/1973 | Tuzi et al. | |
| 3,817,321 | A | | 6/1974 | von Cube et al. | |
| 3,823,572 | A | | 7/1974 | Cochran, Jr. | |
| 3,923,426 | A | | 12/1975 | Theeuwes | 417/48 |
| 3,948,316 | A | | 4/1976 | Souriau | |
| 4,109,707 | A | | 8/1978 | Wilson et al. | |
| 4,138,996 | A | | 2/1979 | Cartland | |
| 4,211,208 | A | | 7/1980 | Lindner | |
| 4,312,012 | A | | 1/1982 | Frieser et al. | |
| 4,450,472 | A | | 5/1984 | Tuckerman et al. | |
| 4,467,861 | A | | 8/1984 | Kiseev et al. | |
| 4,474,172 | A | * | 10/1984 | Burke | 126/598 |
| 4,485,429 | A | | 11/1984 | Mittal | |
| 4,494,171 | A | | 1/1985 | Bland et al. | 361/386 |
| 4,516,632 | A | | 5/1985 | Swift et al. | |
| 4,540,115 | A | | 9/1985 | Hawrylo | |
| 4,561,040 | A | | 12/1985 | Eastman et al. | |
| 4,567,505 | A | | 1/1986 | Pease et al. | |
| 4,573,067 | A | | 2/1986 | Tuckerman et al. | |
| 4,574,876 | A | | 3/1986 | Aid | |
| 4,644,385 | A | | 2/1987 | Nakanishi et al. | |
| 4,758,926 | A | | 7/1988 | Herrell et al. | |
| 4,866,570 | A | | 9/1989 | Porter | |
| 4,868,712 | A | | 9/1989 | Woodman | |
| 4,893,174 | A | | 1/1990 | Yamada et al. | |
| 4,894,709 | A | | 1/1990 | Phillips et al. | |
| 4,896,719 | A | | 1/1990 | O'Neill et al. | |
| 4,903,761 | A | | 2/1990 | Cima | |
| 4,908,112 | A | | 3/1990 | Pace | |
| 4,938,280 | A | | 7/1990 | Clark | |
| 5,009,760 | A | | 4/1991 | Zare et al. | |
| 5,016,090 | A | | 5/1991 | Galyon et al. | |
| 5,016,138 | A | | 5/1991 | Woodman | |
| 5,043,797 | A | | 8/1991 | Lopes | |
| 5,057,908 | A | | 10/1991 | Weber | |
| 5,070,040 | A | | 12/1991 | Pankove | |
| 5,072,596 | A | * | 12/1991 | Gilbertson et al. | 62/185 |
| 5,083,194 | A | | 1/1992 | Bartilson | |
| 5,088,005 | A | | 2/1992 | Ciaccio | |
| 5,096,388 | A | | 3/1992 | Weinberg | |
| 5,099,311 | A | | 3/1992 | Bonde et al. | |
| 5,099,910 | A | | 3/1992 | Walpole et al. | |
| 5,125,451 | A | | 6/1992 | Matthews | |
| 5,131,233 | A | | 7/1992 | Cray et al. | |
| 5,145,001 | A | | 9/1992 | Valenzuela | 165/164 |
| 5,161,089 | A | | 11/1992 | Chu et al. | |
| 5,179,500 | A | | 1/1993 | Koubek et al. | |
| 5,203,401 | A | | 4/1993 | Hamburgen et al. | |
| 5,218,515 | A | | 6/1993 | Bernhardt | |
| 5,219,278 | A | | 6/1993 | Van Lintel | |
| 5,228,502 | A | | 7/1993 | Chu et al. | |
| 5,232,047 | A | | 8/1993 | Matthews | |
| 5,239,200 | A | | 8/1993 | Messina et al. | |
| 5,239,443 | A | | 8/1993 | Fahey et al. | |
| 5,263,251 | A | | 11/1993 | Matthews | |
| 5,265,670 | A | | 11/1993 | Zingher | |
| 5,269,372 | A | | 12/1993 | Chu et al. | |
| 5,274,920 | A | | 1/1994 | Mathews | |
| 5,275,237 | A | | 1/1994 | Rolfson et al. | |
| 5,308,429 | A | | 5/1994 | Bradley | |
| 5,309,319 | A | | 5/1994 | Messina | |
| 5,310,440 | A | | 5/1994 | Zingher | |
| 5,316,077 | A | | 5/1994 | Reichard | |
| 5,317,805 | A | | 6/1994 | Hoopman et al. | |
| 5,325,265 | A | | 6/1994 | Turlik et al. | |
| 5,336,062 | A | | 8/1994 | Richter | |
| 5,346,000 | A | | 9/1994 | Schlitt | |
| 5,371,529 | A | | 12/1994 | Eguchi et al. | |
| 5,380,956 | A | | 1/1995 | Loo et al. | |
| 5,383,340 | A | | 1/1995 | Larson et al. | |
| 5,386,143 | A | | 1/1995 | Fitch | |
| 5,388,635 | A | | 2/1995 | Gruber et al. | |
| 5,421,943 | A | | 6/1995 | Tam et al. | |
| 5,427,174 | A | | 6/1995 | Lomolino, Sr. et al. | |
| 5,436,793 | A | | 7/1995 | Sanwo et al. | |
| 5,441,613 | A | | 8/1995 | McCormick et al. | |
| 5,459,099 | A | | 10/1995 | Hsu | |
| 5,490,117 | A | | 2/1996 | Oda et al. | |
| 5,508,234 | A | | 4/1996 | Dusablon, Sr. et al. | |
| 5,514,832 | A | | 5/1996 | Dusablon, Sr. et al. | |
| 5,514,906 | A | | 5/1996 | Love et al. | |
| 5,534,471 | A | | 7/1996 | Carolan et al. | |
| 5,544,696 | A | | 8/1996 | Leland | |
| 5,548,605 | A | | 8/1996 | Benett et al. | |
| 5,564,497 | A | | 10/1996 | Fukuoka et al. | 165/152 |
| 5,575,929 | A | | 11/1996 | Yu et al. | |
| 5,585,069 | A | | 12/1996 | Zanzucchi et al. | |
| 5,632,876 | A | | 5/1997 | Zanzucchi et al. | |
| 5,641,400 | A | | 6/1997 | Kaltenbach et al. | |
| 5,658,831 | A | | 8/1997 | Layton et al. | |
| 5,675,473 | A | | 10/1997 | McDunn et al. | |
| 5,685,966 | A | | 11/1997 | Aaron et al. | 204/600 |
| 5,692,558 | A | | 12/1997 | Hamilton et al. | |
| 5,696,405 | A | | 12/1997 | Weld | |
| 5,703,536 | A | | 12/1997 | Davis et al. | |
| 5,704,416 | A | | 1/1998 | Larson et al. | |
| 5,727,618 | A | | 3/1998 | Mundinger et al. | |
| 5,740,013 | A | | 4/1998 | Roesner et al. | |
| 5,759,014 | A | | 6/1998 | Van Lintel | |
| 5,763,951 | A | | 6/1998 | Hamilton et al. | |
| 5,768,104 | A | | 6/1998 | Salmonson et al. | |
| 5,774,779 | A | | 6/1998 | Tuchinskiy | |
| 5,800,690 | A | | 9/1998 | Chow et al. | |
| 5,801,442 | A | | 9/1998 | Hamilton et al. | |
| 5,810,077 | A | | 9/1998 | Nakamura et al. | 165/153 |
| 5,835,345 | A | | 11/1998 | Staskus et al. | |
| 5,836,750 | A | | 11/1998 | Cabuz | |
| 5,839,290 | A | | 11/1998 | Nazeri | |
| 5,858,188 | A | | 1/1999 | Soane et al. | |
| 5,863,708 | A | | 1/1999 | Zanzucchi et al. | |
| 5,870,823 | A | | 2/1999 | Bezama et al. | |
| 5,874,795 | A | | 2/1999 | Sakamoto | |
| 5,876,655 | A | | 3/1999 | Fisher | |
| 5,880,524 | A | | 3/1999 | Xie | |
| 5,901,037 | A | | 5/1999 | Hamilton et al. | 361/699 |
| 5,921,087 | A | | 7/1999 | Bhatia et al. | |
| 5,936,192 | A | | 8/1999 | Tauchi | |
| 5,940,270 | A | | 8/1999 | Puckett | |
| 5,942,093 | A | | 8/1999 | Rakestraw et al. | |
| 5,945,217 | A | | 8/1999 | Hanrahan | |
| 5,964,092 | A | | 10/1999 | Tozuka et al. | |
| 5,965,001 | A | | 10/1999 | Chow et al. | |
| 5,965,813 | A | | 10/1999 | Wan et al. | |
| 5,978,220 | A | | 11/1999 | Frey et al. | |
| 5,989,402 | A | | 11/1999 | Chow et al. | |
| 5,993,750 | A | | 11/1999 | Ghosh et al. | |
| 5,997,713 | A | | 12/1999 | Beetz, Jr. et al. | |
| 5,998,240 | A | | 12/1999 | Hamilton et al. | |
| 6,007,309 | A | | 12/1999 | Hartley | |
| 6,010,316 | A | | 1/2000 | Haller et al. | |
| 6,012,902 | A | | 1/2000 | Parce | |
| 6,013,164 | A | | 1/2000 | Paul et al. | |
| 6,019,165 | A | | 2/2000 | Batchelder | |
| 6,019,882 | A | | 2/2000 | Paul et al. | |
| 6,034,872 | A | | 3/2000 | Chrysler et al. | |
| 6,039,114 | A | | 3/2000 | Becker et al. | |
| 6,054,034 | A | | 4/2000 | Soane et al. | |
| 6,068,752 | A | | 5/2000 | Dubrow et al. | |
| 6,090,251 | A | | 7/2000 | Sundberg et al. | |
| 6,096,656 | A | | 8/2000 | Matzke et al. | |
| 6,100,541 | A | | 8/2000 | Nagle et al. | |

| | | | | |
|---|---|---|---|---|
| 6,101,715 | A | 8/2000 | Fuesser et al. | |
| 6,103,199 | A | 8/2000 | Bjornson et al. | 422/100 |
| 6,106,685 | A | 8/2000 | McBride et al. | 204/600 |
| 6,119,729 | A | 9/2000 | Oberholzer et al. | |
| 6,126,723 | A | 10/2000 | Drost et al. | |
| 6,129,145 | A | 10/2000 | Yamamoto et al. | |
| 6,129,260 | A | 10/2000 | Andrus et al. | |
| 6,131,650 | A | 10/2000 | North et al. | 165/170 |
| 6,140,860 | A | 10/2000 | Sandhu et al. | |
| 6,146,103 | A | 11/2000 | Lee et al. | |
| 6,154,226 | A | 11/2000 | York et al. | 346/140.1 |
| 6,154,363 | A | 11/2000 | Chang | |
| 6,159,353 | A | 12/2000 | West et al. | |
| 6,167,948 | B1 | 1/2001 | Thomas | |
| 6,171,067 | B1 | 1/2001 | Parce | |
| 6,174,675 | B1 | 1/2001 | Chow et al. | |
| 6,176,962 | B1 | 1/2001 | Soane et al. | |
| 6,186,660 | B1 | 2/2001 | Kopf-Sill et al. | |
| 6,196,307 | B1 | 3/2001 | Ozmat | 165/185 |
| 6,206,022 | B1 | 3/2001 | Tsai et al. | |
| 6,210,986 | B1 | 4/2001 | Arnold et al. | |
| 6,216,343 | B1 | 4/2001 | Leland et al. | |
| 6,221,226 | B1 | 4/2001 | Kopf-Sill | |
| 6,227,809 | B1 | 5/2001 | Forster et al. | |
| 6,234,240 | B1 | 5/2001 | Cheon | |
| 6,238,538 | B1 | 5/2001 | Parce et al. | |
| 6,251,254 | B1 | 6/2001 | Katoh et al. | 205/287 |
| 6,253,832 | B1 | 7/2001 | Hallefalt | |
| 6,257,320 | B1 | 7/2001 | Wargo | |
| 6,260,579 | B1 | 7/2001 | Yokota et al. | 137/807 |
| 6,277,257 | B1 | 8/2001 | Paul et al. | |
| 6,287,440 | B1 | 9/2001 | Arnold et al. | |
| 6,301,109 | B1 | 10/2001 | Chu et al. | |
| 6,313,992 | B1 | 11/2001 | Hildebrandt | |
| 6,317,326 | B1 | 11/2001 | Vogel et al. | |
| 6,321,791 | B1 | 11/2001 | Chow | |
| 6,322,753 | B1 | 11/2001 | Lindberg et al. | |
| 6,324,058 | B1 | 11/2001 | Hsiao | |
| 6,330,907 | B1 | 12/2001 | Ogushi et al. | |
| 6,336,497 | B1 | 1/2002 | Lin | |
| 6,337,794 | B1 | 1/2002 | Agonafer et al. | |
| 6,351,384 | B1 | 2/2002 | Daikoku et al. | |
| 6,366,462 | B1 | 4/2002 | Chu et al. | |
| 6,366,467 | B1 | 4/2002 | Patel et al. | |
| 6,367,544 | B1 | 4/2002 | Calaman | |
| 6,388,317 | B1 | 5/2002 | Reese | |
| 6,388,385 | B1 | 5/2002 | McGinn et al. | 315/111.91 |
| 6,396,706 | B1 | 5/2002 | Wohlfarth | |
| 6,397,932 | B1 | 6/2002 | Calaman et al. | |
| 6,400,012 | B1 | 6/2002 | Miller et al. | |
| 6,406,605 | B1 | 6/2002 | Moles | |
| 6,415,860 | B1 | 7/2002 | Kelly et al. | |
| 6,416,642 | B1 | 7/2002 | Alajoki et al. | |
| 6,416,672 | B1 * | 7/2002 | Midkiff | 210/714 |
| 6,417,060 | B2 | 7/2002 | Tavkhelidze et al. | |
| 6,424,531 | B1 | 7/2002 | Bhatti et al. | |
| 6,431,260 | B1 | 8/2002 | Agonafer et al. | |
| 6,437,981 | B1 | 8/2002 | Newton et al. | |
| 6,438,984 | B1 | 8/2002 | Novotny et al. | |
| 6,443,222 | B1 | 9/2002 | Yun et al. | |
| 6,443,704 | B1 | 9/2002 | Darabi et al. | 417/50 |
| 6,444,461 | B1 | 9/2002 | Knapp et al. | |
| 6,457,515 | B1 | 10/2002 | Vafai et al. | |
| 6,459,581 | B1 | 10/2002 | Newton et al. | |
| 6,466,442 | B2 | 10/2002 | Lin | |
| 6,477,045 | B1 | 11/2002 | Wang | |
| 6,492,200 | B1 | 12/2002 | Park et al. | |
| 6,495,015 | B1 | 12/2002 | Schoeniger et al. | |
| 6,508,301 | B2 | 1/2003 | Marsala | 165/80.4 |
| 6,519,151 | B2 | 2/2003 | Chu et al. | |
| 6,533,029 | B1 | 3/2003 | Phillips | |
| 6,536,516 | B2 | 3/2003 | Davies et al. | |
| 6,537,437 | B1 | 3/2003 | Galambos et al. | |
| 6,543,521 | B1 | 4/2003 | Sato et al. | |
| 6,553,253 | B1 | 4/2003 | Chang | |
| 6,572,749 | B1 | 6/2003 | Paul et al. | |
| 6,578,626 | B1 | 6/2003 | Calaman et al. | |
| 6,581,388 | B2 | 6/2003 | Novotny et al. | |
| 6,587,343 | B2 | 7/2003 | Novotny et al. | |
| 6,588,498 | B1 | 7/2003 | Reyzin et al. | |
| 6,591,625 | B1 | 7/2003 | Simon | |
| 6,600,220 | B2 | 7/2003 | Barber et al. | |
| 6,601,643 | B2 | 8/2003 | Cho et al. | |
| 6,606,251 | B1 | 8/2003 | Kenny, Jr. et al. | |
| 6,609,560 | B2 | 8/2003 | Cho et al. | |
| 6,632,655 | B1 | 10/2003 | Mehta et al. | |
| 6,632,719 | B1 | 10/2003 | DeBoer et al. | |
| 6,651,735 | B2 | 11/2003 | Cho et al. | |
| 6,719,535 | B2 | 4/2004 | Rakestraw et al. | 417/50 |
| 6,729,383 | B1 | 5/2004 | Cannell et al. | |
| 6,743,664 | B2 | 6/2004 | Liang et al. | |
| 6,770,183 | B1 | 8/2004 | Hencken et al. | |
| 2001/0016985 | A1 | 8/2001 | Insley et al. | |
| 2001/0024820 | A1 | 9/2001 | Mastromatteo et al. | |
| 2001/0044155 | A1 | 11/2001 | Paul et al. | |
| 2001/0045270 | A1 | 11/2001 | Bhatti | |
| 2001/0046703 | A1 | 11/2001 | Burns et al. | |
| 2001/0055714 | A1 | 12/2001 | Cettour-Rose et al. | |
| 2002/0011330 | A1 | 1/2002 | Insley et al. | |
| 2002/0075645 | A1 | 6/2002 | Kitano et al. | |
| 2002/0096312 | A1 | 7/2002 | Korin | |
| 2002/0121105 | A1 | 9/2002 | McCarthy, Jr. et al. | |
| 2002/0134543 | A1 | 9/2002 | Estes et al. | |
| 2003/0022505 | A1 | 1/2003 | Ouellet et al. | |
| 2003/0062149 | A1 | 4/2003 | Goodson et al. | 165/104.11 |
| 2003/0121274 | A1 | 7/2003 | Wightman | |
| 2003/0213580 | A1 | 11/2003 | Philpott et al. | |
| 2004/0040695 | A1 | 3/2004 | Chesser et al. | |
| 2004/0052049 | A1 | 3/2004 | Wu et al. | |
| 2004/0089008 | A1 | 5/2004 | Tilton et al. | |
| 2004/0112571 | A1 | 6/2004 | Kenny et al. | 165/80.3 |
| 2004/0120827 | A1 | 6/2004 | Kim et al. | |
| 2004/0125561 | A1 | 7/2004 | Gwin et al. | |
| 2004/0160741 | A1 | 8/2004 | Moss et al. | |
| 2004/0188069 | A1 | 9/2004 | Tomioka et al. | |
| 2004/0216863 | A1 * | 11/2004 | Hu | 165/110 |
| 2005/0084385 | A1 | 4/2005 | Corbin et al. | 417/53 |
| 2005/0168949 | A1 | 8/2005 | Tilton et al. | 361/699 |

FOREIGN PATENT DOCUMENTS

| | | |
|---|---|---|
| DE | 197 10 716 C2 | 9/1998 |
| JP | 1-256775 | 10/1989 |
| JP | 10-99592 | 4/1998 |
| JP | 2000-277540 | 10/2000 |
| JP | 2001-326311 | 11/2001 |
| WO | WO 01/25711 A1 | 4/2001 |
| WO | WO 2004/036040 A1 | 4/2004 |
| WO | WO 2004/076857 A3 | 9/2004 |

OTHER PUBLICATIONS

Kendra V. Sharp et al., "Liquid Flows in Microchannels", 2002, vol. 6, pp. 6-1 to 6-38.

Shuchi Shoji et al., "Microflow devices and systems", J. Microcech. Microeng. 4 (1994), pp. 157-171, printed in the U.K.

Angela Rasmussen et al., "Fabrication Techniques to Realize CMOS-Compatible Microfluidic Microchannels", Journal of Microelectromechanical Vo. 10, No. 2, Jun. 2001, pp. 286-297.

J. H. Wang et al., "Thermal-Hydraulic Characteristic of Micro Heat Exchangers", 1991, DSC-vol. 32, Micromechanical Sensors, Actuators, and Systems, pp. 331-339.

Gad Hetsroni et al., "Nonuniform Temperature Distribution in Electronic Devices Cooled by Flow in Parallel Microchannels", IEEE Transactions on Components and Packaging Technologies, Mar. 2001, vol. 24, No. 1, pp. 16-23.

X. F. Peng et al., "Heat Transfer Characteristics of Water Flowing through Microchannels", Experimental Heat Transfer An International Journal, vol. 7, No. 4, Oct.-Dec. 1994, pp. 265-283.
Linan Jiang et al., "Forced Convection Boiling in a Microchannel Heat Sink", Journal of Microelectromechanical Systems, vol. 10, No. 1, Mar. 2001, pp. 80-87.
Muhammad M. Rahman et al., "Experimental Measurements of Fluid Flow and Heat Transfer in Microchannel Cooling Passages in a Chip Substrate", 1993, EEP—vol. 4-2, Advances in Electronic Packages, pp. 685-692.
X. F. Peng et al., "Forced convection and flow boiling heat transfer for liquid flowing through Microchannels", 1993, Int. J. Heat Mass Transfer, vol. 36, No. 14, pp. 3421-3427.
Lung-Jieh Yang et al., "A Micro Fluidic System of Micro Channels with On-Site Sensors by Silicon Bulk Micromaching", Sep. 1999, Microfluidic Devices and Systems II, vol. 3877, pp. 267-272.
G. Mohiuddin Mala et al., "Heat transfer and fluid flow in microchannels", 1997, Int. J. Mass transfer, vol. 40, No. 13, pp. 3079-3088, printed in Great Britain.
J. M. Cuta et al., "Fabrication and Testing of Micro-Channel Heat Exchangers", SPIE Microlithography and Metrology in Micromaching, vol. 2640, 1995, pp. 152-160.
Linan Jiang et al., "A Micro-Channel Heat Sink with Integrated Temperature Sensors for Phase Transition Study", 1999, 12th IEEE International Conference on Micro Electro Mechanical Systems, pp. 159-164.
Linan Jiang et al., "Fabrication and characterization of a microsystem for a micro-scale heat transfer study", J. Micromech. Microeng. 9 (1999) pp. 422-428, printed in the U.K.
M. B. Bowers et al., "High flux boiling in low flow rate, low pressure drop mini-channel and micro-channel heat sinks", 1994, Int. J. Heat Mass Transfer, vol. 37, No. 2, pp. 321-332.
Yongendra Joshi, "Heat out of small packages", Dec. 2001, Mechanical Engineering, pp. 56-58.
A. Rostami et al., "Liquid Flow and Heat Transfer in Microchannels: A Review", 2000, Heat and Technology, vol. 18, No. 2, pp. 59-68.
Lian Zhang et al., "Measurements and Modeling of Two-Phase Flow in Microchannels with Nearly Constant Heat Flux Boundary Conditions", Journal of Microelectromechanical Systems, vol. 11, No. 1, Feb. 2002, pp. 12-19.
Muhammad Mustafizur Rahman, "Measurements of Heat Transfer in Microchannel Heat Sinks", Int. Comm. Heat Mass Transfer, vol. 27, No. 4, May 2000, pp. 495-506.
Issam Mudawar et al., "Enhancement of Critical Heat Flux from High Power Microelectronic Heat Sources in a Flow Channel", Journal of Electronic Packaging, Sep. 1990, vol. 112, pp. 241-248.
Nelson Kuan, "Experimental Evaluation of Micro Heat Exchangers Fabricated in Silicon", 1996, HTD-vol. 331, National Heat Transfer Conference, vol. 9, pp. 131-136.
E. W. Kreutz et al., "Simulation of micro-channel heat sinks for optoelectronic microsystems", Microelectronics Journal 31 (2000), pp. 787-790.
J. C. Y. Koh et al., "Heat Transfer of Microstructures for Integrated Circuits", 1986, Int. Comm. Heat Mass Transfer, vol. 13, pp. 89-98.
Snezana Konecni et al., "Convection Cooling of Microelectronic Chips", 1992, InterSociety Conference on Thermal Phenomena, pp. 138-144.
Michael B. Kleiner et al., "High Performance Forced Air Cooling Scheme Employing Microchannel Heat Exchangers", Dec. 1995, IEEE Transactions on Components, Packaging, and Manufacturing Technology-Part A, vol. 18, No. 4, pp. 795-804.
Jerry K. Keska Ph. D. et al., "An Experimental Study on an Enhanced Microchannel Heat Sink for Microelectronics Applications", EEP-vol. 26-2, Advances in Electronic Packaging, 1999, vol. 2, pp. 1235-1259.
Shung-Wen Kang et al., "The Performance Test and Analysis of Silicon-Based Microchannel Heat Sink", Jul. 1999, Terahertz and Gigahertz Photonics, vol. 3795, pp. 259-270.
Joseph C. Tramontana, "Semiconductor Laser Body Heat Sink", Xerox Disclosure Journal, vol. 10, No. 6, Nov./Dec. 1985, pp. 379-381.
Sarah Arulanandam et al., "Liquid transport in rectangular microchannels by electroosmotic pumping", Colloids and Surfaces A: Physicochemical and Engineering Aspects 161 (2000), pp. 89-102.
Jeffery D. Barner et al., "Thermal Ink Jet Print Head Carriage with Integral Liquid Cooling Capabilities", Xerox Disclosure Journal-vol. 21, No. 1, Jan./Feb. 1996, pp. 33-34.
"Autonomous displacement of a solution in a microchannel by another solution", Research Disclosure, Jun. 2001, pp. 1046-1047.
John M. Waldvogel, "Aluminum Silicon Carbide Phase Change Heat Spreader", Motorola, Jun. 1999, Technical Developments, pp. 226-230.
James P. Slupe et al., "An idea for maintaining a stable thermal environment for electronic devices", Research Disclosure, Aug. 2001, p. 1312.
John M. Waldvogel, "A Heat Transfer Enhancement Method for Forced Convection Bonded-Fin Heatsinks", Motorola, Dec. 1997, Technical Developments, pp. 158-159.
"Thin Heat Pipe for Cooling Components on Printed Circuit Boards", IBM Technical Disclosure Bulletin, vol. 34, No. 7B, Dec. 1991, pp. 321-322.
R. C. Chu et al., "Process for Nucleate Boiling Enhancement", IBM Technical Disclosure Bulletin, vol. 18, No. 7, Dec. 1975, p. 2227.
J. Riseman, "Structure for Cooling by Nucleate Boiling", IBM Technical Disclosure Bulletin, vol. 18, No. 1, Apr. 1976, p. 3700.
"Integrally Grooved Semiconductor Chip and Heat Sink", Oct. 1971, IBM Technical Disclosure Bulletin, vol. 14, No. 5, p. 1425.
"Enhanced Cooling of Thermal Conduction Module", IBM Technical Disclosure Bulletin, vol. 30, No. 5, Oct. 1987, p. 426.
"Heat Exchanger Modules for Data Processor with Valves Operated by Pressure from Cooling Water Pump", IBM Technical Disclosure Bulletin, vol. 30, No. 5, Oct. 1987, p. 419.
"Cold Plate for Thermal Conduction Module with Inlet for Cooling Water Near Highest Power Chips", IBM Technical Disclosure Bulletin, vol. 30, No. 5, Oct. 1987, p. 413.
"Circuit Module Cooling with Coaxial Bellows Providing Inlet, Outlet and Redundant Connections to Water-Cooled Element", IBM Technical Bulletin, vol. 30, No. 5, Oct. 1987, pp. 345-347.
"Piping System with Valves Controlled by Processor for Heating Circuit Modules in a Selected Temperature Profile for Sealing Integrity Test Under Temperature Stress", IBM Technical Disclosure Bulletin, vol. 30, No. 5, Oct. 1987, p. 336.
"Cooling System for Chip Carrier on Card", IBM Technical Disclosure Bulletin, vol. 31, No. 4, Sep. 1988, pp. 39-40.
"Chip Cooling Device", IBM Technical Disclosure Bulletin, vol. 30, No. 9, Feb. 1988, pp. 435-436.
W. E. Ahearn et al., "Silicon Heat Sink Method to Control Integrated Circuit Chip Operating Temperatures", IBM Technical Disclosure Bulletin, vol. 21, No. 8, Jan. 1979, pp. 3378-3380.
N. P. Bailey et al., "Cooling Device for Controlled Rectifier", IBM Technical Disclosure Bulletin, vol. 21, No. 11, Apr. 1979, pp. 4609-4610.
W. J. Kleinfelder et al., "Liquid-Filled Bellows Heat Sink", IBM Technical Disclosure Bulletin, vol. 21, No. 10, Mar. 1979, pp. 4125-4126.
R. P. Chrisfield et al., "Distributed Power/Thermal Control", IBM Technical Disclosure Bulletin, vol. 22, No. 3, Aug. 1979, pp. 1131-1132.
A. J. Arnold et al., "Heat Sink Design for Cooling Modules in a Forced Air Environment", IBM Technical Disclosure Bulletin, vol. 22, No. 6, Nov. 1979, pp. 2297-2298.
A. J. Arnold, "Structure for the Removal of Heat from an Integrated Circuit Module", IBM Technical Disclosure Bulletin, vol. 22, No. 6, Nov. 1979, pp. 2294-2296.
U. P. Hwang et al., "Cold Plate for Thermal Conduction Module with Improved Flow Pattern and Flexible Base", IBM Technical Disclosure Bulletin, vol. 25, No. 9, Feb. 1983, p. 4517.
K. C. Gallagher et al., "Cooling System for Data Processor with Flow Restrictor in Secondary Loop to Limit Bypass-Cooling Water Flow", IBM Technical Disclosure Bulletin, vol. 26, No. 5, Oct. 1983, p. 2658.
R. C. Chu et al., "Silicon Heat Sink for Semiconductor Chip", IBM Technical Disclosure Bulletin, vol. 24, No. 11A, Apr. 1982, p. 5743.

J. M. Eldridge et al., "Heat-Pipe Vapor Cooling Etched Silicon Structure", IBM Technical Disclosure Bulletin, vol. 25, No. 8, Jan. 1983, pp. 4118-4119.
J. R. Skobern, "Thermoelectrically Cooled Module", IBM Technical Disclose Bulletin, vol. 27, No. 1A, Jun. 1984, p. 30.
M. J. Brady et al., "Etched Silicon Integrated Circuit Heat Sink", IBM Technical Disclosure Bulletin, vol. 27, No. 1B, Jun. 1984, p. 627.
H. D. Edmonds et al., "Heat Exchange Element for Semiconductor Device Cooling", IBM Technical Disclosure Bulletin, vol. 23, No. 3, Aug. 1980, p. 1057.
R. W. Noth, "Heat Transfer from Silicon Chips and Wafers", IBM Technical Disclosure Bulletin, vol. 17, No. 12, May 1975, p. 3544.
"Forced Boiling Cooling System with Jet Enhancement for Critical Heat Flux Extension", IBM Technical Disclosure Bulletin, vol. 39, No. 10, Oct. 1996, p. 143.
"Miniature Heat Exchanger for Corrosive Media", IBM Technical Disclosure Bulletin, vol. 38, No. 1, Jan. 1995, pp. 55-56.
"Self-Contained Active Heat Dissipation Device", IBM Technical Disclosure Bulletin, vol. 39, No. 4, Apr. 1996, pp. 115-116.
C. J. Keller et al., "Jet Cooling Cup for Cooling Semiconductor Devices", IBM Technical Disclosure Bulletin, vol. 20, No. 9, Feb. 1978, pp. 3575-3576.
B. J. Ronkese, "Centerless Ceramic Package with Directly Connected Heat Sink", IBM Technical Disclosure Bulletin, vol. 20, No. 9, Feb. 1978, p. 3577-3578.
K. S. Sachar, "Liquid Jet Cooling of Integrated Circuit Chips", vol. 20, No. 9, Feb. 1978, pp. 3727-3728.
A. H. Johnson, "Device Cooling", IBM Technical Disclosure Bulletin, vol. 20, No. 10, Mar. 1978, pp. 3919-3920.
R. D. Durand et al., "Flexible Thermal Conductor for Electronic Module", IBM Technical Disclosure Bulletin, vol. 20, No. 11A, Apr. 1978, p. 4343.
D. Balderes et al., "Liquid Cooling of a Multichip Module Package", IBM Technical Disclosure Bulletin, vol. 20, No. 11A, Apr. 1978, pp. 4336-4337.
J. A. Dorler et al., "Temperature Triggerable Fluid Coupling System for cooling Semiconductor Dies", IBM Technical Disclosure Bulletin, vol. 20, No. 11A, Apr. 1978, pp. 4386-4388.
V. W. Antonetti et al., "Integrated Module Heat Exchanger", IBM Technical Disclosure Bulletin, vol. 20, No. 11A, Apr. 1978, p. 4498.
P. Hwang et al., "Conduction Cooling Module", IBM Technical Disclosure Bulletin, vol. 20, No. 11A, Apr. 1978, pp. 4334-4335.
A. J. Arnold et al., "Electronic Packaging Structure", IBM Technical Disclosure Bulletin, vol. 20, 11B, Apr. 1978, pp. 4820-4822.
V. Y. Doo et al., "High Performance Package for Memory", IBM Technical Disclosure Bulletin, vol. 21, No. 2, Jul. 1978, pp. 585-586.
"Multi-Chip Package with Cooling by a Spreader Plate in Contact with a Chip having Cylindrical Holes Mating with an Inverse Frame Providing Water Flow Within its Pins", IBM Technical Disclosure Bulletin, vol. 31, No. 5, Oct. 1988, pp. 141-142.
J. Landrock et al., "Cooling System for Semiconductor Chips", IBM Technical Disclosure Bulletin, vol. 23, No. 4, Sep. 1980, p. 1483.
E. P. Damm, Jr., "Convection Cooling Apparatus", IBM Technical Disclosure Bulletin, vol. 20, No. 7, Dec. 1977, pp. 2755-2756.
"Circuit Package with Circulating Boiling Liquid and Local Heat Exchanger to Limit Vapor in Coolant Outlet", IBM Technical Disclosure Bulletin, vol. 31, No. 12, May 1989, p. 34.
"Circuit Module Cooling with Multiple Pistons Contacting a Heat Spreader/Electrical Buffer Plate in Contact with Chip", IBM Technical Disclosure Bulletin, vol. 31, No. 12, May 1989, p. 5-7.
"TCM-LIKE Circuit Module with Local Heat Sink Resting on Chip and Chip Separated From Coolant by Bellows with Pins and Deflector Plate Attached to Local Heat Sink and Extending Above Bellows into Region of Coolant Flow", IBM Technical Disclosure Bulletin, vol. 31, No. 11, pp. 305-306.
"Water-Cooled Circuit Module with Grooves Forming Water Passages Near Heat-Producing Devices", IBM Technical Disclosure Bulletin, vol. 31, No. 12, May 1989, pp. 49-50.
"Cold Plate for Thermal Conduction Module with Only Peripheral Mounting Bolts, Large Surface Area Fin Inserts and Reduced Water Flow and Thermal Resistances", IBM Technical Disclosure Bulletin, vol. 31, No. 12, May 1989, p. 59.
"Thermal Control Hardware for Accelerated Run-In Testing of Multi-Chip Modules", IBM Technical Disclosure Bulletin, vol. 32, No. 5A, Oct. 1989, p. 129-130.
"Means of Removing More Heat from a TCM (Or Other Liquid-Cooled Logic Package) By Reducing the Coolant Temperature", IBM Technical Disclosure Bulletin, vol. 32, No. 5A, Oct. 1989, pp. 153-154.
E. G. Loeffel et al., "Liquid Cooled Module with Compliant Membrane", IBM Technical Disclosure Bulletin vol. 20, No. 2, Jul. 1977, pp. 673-674.
V. Y. Doo et al., "Method of Effective Cooling of a High Power Silicon Chip", IBM Technical Disclosure Bulletin, vol. 20, No. 4, Sep. 1977, p. 1436-1437.
V. Y. Doo et al., Semiconductor Chip Cooling Package, IBM Technical Disclosure Bulletin, vol. 20, No. 4, Sep. 1977, pp. 1440-1441.
"Heat Sink Fabrication Method", IBM Technical Disclosre Bulletin, vol. 27, No. 10A, Mar. 1985, p. 5656-5657.
"Thermal Conductio Module with Liquid Dielectric and Pistons with Surface Treatment for Enhanced Nucleate Boiling", IBM Technical Disclosure Bulletin, vol. 27, No. 12, May 1985, p. 6904.
"Pin Fin Array Heat Pipe Apparatus", IBM Technical Disclosure Bulletin, vol. 37, No. 09, Sep. 1994, p. 171.
Youngcheol Joo et al., "Fabrication of Monolithic Microchannels for IC Chip Cooling", 1995, IEEE Micro Electro Mechanical Systems, pp. 362-367.
Jaisree Moorthy et al., "Active control of electroosmotic flow in microchannels using light", Jan. 26, 2001, Sensors and Actuators B 75, pp. 223-229.
Andreas Manz et al., "Electroosmotic pumping and electrophoretic separations for miniaturized chemical analysis systems", Sep. 16, 1994, J.Micromech. Microeng. 4 (1994), pp. 257-265, printed in the U.K.
E. B. Cummings et al., "Irrotationally of uniform electroosmosis", Sep. 1999, Part of the SPIE Conference on Microfluidic Devices and Systems II, SPIE vol. 3877, pp. 180-189.
Haim H. Bau, "Optimization of conduits' shape in micro heat exchangers", Dec. 10, 1997, International Journal of Heat and Mass Transfer 41 (1998), pp. 2717-2723.
V. K. Dwivedi et al., "Fabrication of very smooth walls and bottoms of silicon microchannels for heat dissipation of semiconductor devices", Jan. 25, 2000, Microelectronics Journal 31 (2000), pp. 405-410.
M. B. Bowers et al.,, "Two-Phase Electronic Cooling Using Mini-Channel and Micro-Channel Heat Sinks: Part 2-Flow Rate and Pressure Drop Constraints", Dec. 1994, Journal of Electronic Packaging, vol. 116, pp. 298-305.
Meint J. de Boer et al., "Micromachining of Buried Micro Channels in Silicon", Mar. 2000, Journal of Microelectromechanical systems, vol. 9, No. 1, pp. 94-103.
S.B. Choi et al., "Fluid Flow and Heat Transfer in Microtubes", 1991 DSC-vol. 32, Micromechanical sensors, Actuators, and Systems, ASME 1991, pp. 123-134.
S. F. Choquette, M. Faghri et al., "Optimum Design of Microchannel Heat Sinks", 1996, DSC-vol. 59, Microelectromechanical Systems (MEMS), ASME 1996, pp. 115-126.
David Copeland et al., "Manifold Microchannel Heat Sinks: Theory and Experiment", 1995, EEP-vol. 10-2, Advances in Electronic Packaging ASME, 1995, pp. 829-835.
J. M. Cuta et al., "Forced Convection Heat Transfer in Parallel Channel Array Microchannel Heat Exchanger", 1996, PID-vol. 2 / HTD-vol. 338, Advances in Energy efficiency, Heat/Mass Transfer Enhancement, ASME 1996, pp. 17-23.
K. Fushinobu et al., "Heat Generation and Transport in Sub-Micron Semiconductor Devices", HTD-vol. 253, Heat Transfer on the Microscale, ASME 1993, pp. 21-28.
Charlotte Gillot et al., "Integrated Micro Heat Sink for Power Multichip Module", IEEE Transactions on Industry Applications, vol. 36, No. 1, Jan./Feb. 2000, pp. 217-221.
John Gooding, "Microchannel heat exchangers—a review", SPIE vol. 1997 High Heat Flux Engineering II (1993), pp. 66-82.

Koichiro Kawano et al., "Micro Channel Heat Exchanger for Cooling Electrical Equipment", HTD-vol. 361-3/PID-vol. 3, Proceedings of the ASME Heat Transfer Division—vol. 3, ASME 1998, pp. 173-188.
Chad Harris et al., "Design and Fabrication of a Cross Flow Micro Heat Exchanger", Dec. 2000, Journal of Microelectromechanical Systems, vol. 9, No. 4, pp. 502-508.
George M. Harpole et al., "Micro-Channel Heat Exchanger Optimization", 1991, Seventh IEEE SEMI-THERM Symposium, pp. 59-63.
Pei-Xue Jiang et al., "Thermal-hydraulic performance of small scale micro-channel and porous-media heat-exchangers", International Journal of Heat and Mass Transfer 44 (2001), pp. 1039-1051.
X.N. Jiang et al., "Laminar Flow Through Microchannels Used for Microscale Cooling Systems", 1997, IEEE/CPMT Electronic Packaging Technology Conference, pp. 119-122.
David Bazeley Tuckerman, "Heat-Transfer Microstructures for Integrated Circuits", Feb. 1984, pp. ii-xix, pp. 1-141.
M. Esashi, "Silicon micromachining for integrated microsystems", Vacuum/vol. 47/Nos. 6-8/pp. 469-474.
T.S. Ravigunajan et al., "Effects of Heat Flux on Two-Phase Flow Characteristics of Refrigerant Flows in a Micro-Channel Heat Exchanger", HTD-vol. 329, National Heat Transfer Conference, vol. 7, ASME 1996, pp. 167-178.
T.S. Ravigrurujan et al., "Single-Phase Flow Thermal Performance Characteristics of a Parallel Micro-Channel Heat Exchanger", 1996, HTD-vol. 329, National Heat Transfer Conference, vol. 7, ASME 1996, pp. 157-166.
T.S. Ravigururajan et al., "Liquid Flow Characteristics in a Diamond-Pattern Micro-Heat-Exchanger", DSC-vol. 59 Microelectromechanical Systems (MEMS), ASME 1996, pp. 159-166.
T.S. Raviguruajan, "Impact of Channel Geometry on Two-Phase Flow Heat Transfer Characteristics of Refrigerants in Microchannel Heat Exchangers", May 1998, Journal of Heat Transfer, vol. 120, pp. 485-491.
J. Pfahler et al., "Liquid Transport in Micron and Submicron Channels", Mar. 1990, Sensors and Actuators, A21-A23 (1990), pp. 431-434.
Kenneth Pettigrew et al., "Performance of a MEMS based Micro Capillary Pumped Loop for Chip-Level Temperature Control", 2001, The 14th IEEE International Conference on Micro Electro Mechanical Systems, pp. 427-430.
C. Perret et al., "Microchannel integrated heat sinks in silicon technology", Oct. 12-15, 1998, The 1998 IEEE Industry Applications Conference, pp. 1051-1055.
X.F. Peng et al., "Convective heat transfer and flow friction for water flow in microchannel structures", 1996, Int. J. Heat Mass Transfer, vol. 39, No. 12, pp. 2599-2608, printed in Great Britain.
X.F. Peng et al., "Experimental investigation of heat transfer in flat plates with rectangular microchannels", 1994, Int. J. Heat Mass Transfer, vol. 38, No. 1, pp. 127-137, printed in Great Britain.
X.F. Peng et al., "Cooling Characteristics with Microchanneled Structures", 1994, Enhanced Heat Transfer, vol. 1, No. 4, pp. 315-326, printed in the United States of America.
X.F. Peng et al., "Enhancing the Critical Heat Flux Using Microchanneled Surfaces", 1998, Enhanced Heat Transfer, vol. 5, pp. 165-176, Printed in India.
Yoichi Murakami et al., "Parametric Optimization of Multichananneled Heat Sinks for VLSI Chip Cooling", Mar. 2001, IEEE Transactions on Components and Packaging Technologies, vol. 24, No. 1, pp. 2-9.
D. Mundinger et al., "High average power 2-D laser diode arrays on silicon microchannel coolers", CLEO '89/Friday Morning/404.
L.J. Missaggia et al., "Microchannel Heat Sinks for Two-Dimensional High-Power-Density Diode Laser Arrays", 1989, IEEE Journal of Quantum Electronics, vol. 25, No. 9, Sep. 1989, pp. 1988-1992.
M.J. Marongiu et al., "Enhancement of Multichip Modules (MCMs) Cooling by Incorporating MicroHeatPipes and Other High Thermal Conductivity Materials into Microchannel Heat Sinks", 1998, Electronic Components and Technology Conference, pp. 45-50.
C.R. Friedrich et al., "Micro heat exchangers fabricated by diamond machining", Jan. 1994, Precision Engineering, vol. 16, No. 1, pp. 56-59.
Mali Mahalingam, "Thermal Management in Semiconductor Device Packaging", Proceedings of the IEEE, vol. 73, No. 9, Sep. 1985, pp. 1396-1404.
T.M. Adams et al., "An experimental investigations of single-phase forced convection in microchannels", 1997, Int. J. Heat Mass Transfer, vol. 41, Nos. 6-7, pp. 851-857, Printed in Great Britain.
T.M. Adams et al., "Applicability of traditional tubulent single-phase forced convection correlations to non-circular microchannels", 1999, Int. J. Heat and Transfer 42 (1999), pp. 4411-4415.
Bassam Badran et al., "Experimental Results for Low-Temperature Silicon Micromachined Micro Heat Pipe Arrays Using Water and Methanol as Working Fluids", May 31, 1997, Experimental Heat Transfer, 10: pp. 253-272.
D. Jed Harrison et al., "Electroosmotic Pumping Within A Chemical Sensor System Integrated on Silicon", Session C9 Chemical Sensors and Systems for Liquids, Jun. 26, 1991, pp. 792-795.
Kurt Seller et al., "Electroosmotic Pumping and Valveless Control of Fluid Flow within a Manifold of Capillaries on a Glass Chip", 1994, Analytical Chemistry, vol. 66, No. 20, Oct. 15, 1994, pp. 3485-3491.
Philip H. Paul et al., "Electrokinetic Generation of High Pressures Using Porous Microstructures", 1998, Micro-Total Analysis Systems, pp. 49-52.
Gh. Mohiuddin Mala et al., "Flow characteristics of water through a microchannel between two parallel plates with electrokinetic effects", Oct. 1997, Int. J. Heat and Fluid Flow, vol. 18, No. 5, pp. 489-496.
W.E. Morf et al., "Partial electroosmotic pumping in complex capillary systems Part 1: Principles and general theoretical approach", Oct. 16, 2000, Sensors and Actuators B 72 (2001), pp. 266-272.
M. Esashi, "Silicon micromachining and micromachines", Wear, vol. 168, No. 1-2, (1993), pp. 181-187.
Stephanus Buttgenbach et al., "Microflow devices for miniaturized chemical analysis systems", Nov. 1998, SPIE-Chemical Microsensors and Applications, vol. 3539, pp. 51-61.
Sarah Arunlanandam et al., "Liquid transport in rectangular microchannels by electroosmotic pumping", Colloids and Surfaces A: Physicochemical and Engineering Aspects, vol. 161 (2000), pp. 89-102.
Linan Jiang et al., "Closed-Loop Electroosmotic Microchannel Cooling System for VLSI Circuits", Mechanical Engineering Dept. Stanford University, pp. 1-27.
Susan L. R. Barker et al., "Fabrication, Derivatization and Applications of Plastic Microfluidic Devices", Proceedings of SPIE, vol. 4205, 2000 pp. 112-118.
Timothy E. McKnight et al., "Electroosmotically Induced Hydraulic Pumping with Integrated Electrodes on Microfluidic Devices", Aug. 15, 2001, Anal. Chem., vol. 73, No. 16, pp. 4045-4049.
Chris Bourne, "Cool Chips plc Receives Nanotech Manufacturing Patent", Jul. 31, 2002, pp. 1-2.
Frank Wagner et al., "Electroosmotic Flow Control in Micro Channels Produced by Scanning Excimer Laser Ablation", Proceedings of SPIE vol. 4088, 2000, pp. 337-340.
H. A. Goodman, "Data Processor Cooling With Connection To Maintain Flow Through Standby Pump", Dec. 1983, IBM Technical Disclosure Bulletin, vol. 26, No. 7A, p. 3325.
"Electroerosion Micropump", May 1990, IBM Technical Disclosure Bulletin, vol. 32, No. 12, pp. 342-343.
Shulin Zheng et al., "Fabrication and Characterization of Electrokinetic Micro Pumps", 2000 Inter Society Conference on Thermal Phenomena, pp. 31-35.
A. Manz et al., "Integrated Electroosmotic Pumps and Flow Manifolds for Total Chemical Analysis Systems", 1991, Inter. Conf. on Solid-State Sensors and Actuators, pp. 939-941.
O. T. Guenat et al., "Partial electroosmotic pumping in complex capillary systems Part: 2 Fabrication and application of a micro total analysis system suited for continuous volumetric nanotitrations", Sensors and Actuators B 72 (2001) pp. 273-282.

J. G. Sunderland, "Electrokinetic dewatering and thickening. I. Introduction and historical review of electrokinetic applications", Feb. 1987, Journal of Applied Electrochemistry, vol. 17, No. 5, pp. 889-898.
J. C. Rife et al., "Acousto- and electroosmotic microfluidic controllers", Sep. 1998, Microfluidic Device and Systems, vol. 3515, pp. 125-135.
Purnendu K. Dasgupta et al., "Electroosmotic: A Reliable Fluid Propulsion System for Flow Injection Analysis", Jun. 1994, Anal. Chem., vol. 66, No. 11, pp. 1792-1798.
Ray Beach et al., "Modular Microchannel Cooled Heatsinks for High Average Power Laser Diode Arrays", Apr. 1992, IEEE Journal of Quantum Electronics, vol. 28, No. 4, pp. 966-976.
Roy W. Knight et al., "Optimal Thermal Design of Air cooled Forced Convection Finned Heat Sinks—Experimental Verification", Oct. 1992, IEEE Transactions on Components, Hybrids, and Manufacturing Technology, vol. 15, No. 5, pp. 754-760.
Y. Zhuang et al., "Experimental study on local heat transfer with liquid impingement flow in two-dimensional micro-channels", 1997, Int. J. Heat Mass Transfer, vol. 40, No. 17, pp. 4055-4059.
D. Yu et al., "An Experimental and Theoretical Investigation of Fluid Flow and Heat Transfer in Microtube", 1995, ASME / JSME Thermal Engineering Conference, vol. 1, pp. 523-530.
Xiaoqing Yin et al., "Micro Heat Exchangers Consisting of Pin Arrays", Journal of Electronic Packaging, Mar. 1997, vol. 119, pp. 51-57.
X. Yin et al., "Uniform Channel Micro Heat Exchangers", Journal of Electronic Packaging, Jun. 1997, vol. 119, pp. 89-94.
Chun Yang et al., "Modeling forced liquid convection in rectangular microchannels with electrokinetic effects", International Journal of Heat and Mass Transfer 41 (1998), pp. 4229-4249.
Arel Weisberg et al., "Analysis of microchannels for integrated cooling", 1992, Int. J. Heat Mass Transfer, vol. 35, No. 10, pp. 2465-2473.
Roger S. Stanley et al., "Two-Phase Flow in Microchannels", 1997, DSC-vol. 62/HTD-vol. 354, MEMS, pp. 143-152.
B. X. Wang et al., "Experimental investigation on liquid forced-convection heat transfer through microchannels", 1994, Int. J. Heat Mass Transfer, vol. 37, Suppl. 1, pp. 73-82.
Kambiz Vafai et al., "Analysis of two-layered micro-channel heat sink concept in electronic cooling", Int. J. Heat Mass Transfer, 42 (1999), pp. 2287-2297.
Gokturk Tunc et al., "Heat transfer in rectangular microchannels", Int. J. Heat Mass Transfer, 45 (2002), pp. 765-773.
D. B. Tuckerman et al., "High-Performance Heat Sinking for VLSI", May 1981, IEEE Electron Devices Letters, vol. EDL-2, No. 5, pp. 126-129.
Bengt Sunden et al., "An Overview of Fabrication Methods and Fluid Flow and Heat Transfer Characteristics of Micro Channels", pp. 3-23.
David S. Shen et al., "Micro Heat Spreader Enhanced Heat Transfer in MCMs", 1995, IEEE Multi-Chip Module Conference, pp. 189-194.
S. Sasaki et al., "Optimal Structure for Microgrooved Cooling Fin for High-Power LSI Devices", Electronic Letters, Dec. 4, 1986, vol. 22, No. 25.
Vijay K. Samalam, "Convective Heat Transfer in Microchannels", 1989, Journal of Electronic Materials, vol. 18, No. 5, pp. 611-617.
Sanjay K. Roy et al., "A Very High Heat Flux Microchannel Heat Exchanger for Cooling of Semiconductor Laser Diode Arrays", May 1996, IEEE Transactions on components, packaging, and manufacturing technology-part B, vol. 19, No. 2, pp. 444-451.
Charlotte Gillot et al., "Integrated Single and Two-Phase Micro Heat Sinks Under IGBT Chips", IEEE Transactions on Components and Packaging Technology, vol. 22, No. 3, Sep. 1999, pp. 384-389.
A.L. Pascuzzo et al., "Integrated Circuit Module Package Cooling Structure", IBM vol. 20, No. 10, Mar. 1978, pp. 3898-3899.
H. Krumm, "Chip Cooling", IBM Technical Disclosure Bulletin, vol. 20, No. 7, Dec. 1977, p. 2728.
Jae-Mo Koo et al., "Modeling of Two-Phase Microchannel Heat Sinks for VLSI Chips", Mech. Eng. Depart. of Stanford University, pp. 422-426.

* cited by examiner

METHOD AND APPARATUS FOR CONTROLLING FREEZING NUCLEATION AND PROPAGATION

RELATED APPLICATION

This application claims priority under 35 U.S.C. § 119(e) of the U.S. provisional patent application Ser. No. 60/577,262, filed on Jun. 4, 2004, and titled "MULTIPLE COOLING TECHNIQUES." The provisional patent application Ser. No. 60/577,262, filed on Jun. 4, 2004, and titled "MULTIPLE COOLING TECHNIQUES" is hereby incorporated by reference.

FIELD OF THE INVENTION

The present invention relates generally to an apparatus and method of controlling freezing in a liquid system, such as may be useful for transferring heat from electronic devices and components thereof. In particular, the invention protects against expansion of fluid during freezing by initiating the expansion of frozen fluid in the direction of zones having progressively decreasing surface area to volume ratios.

BACKGROUND OF THE INVENTION

Freezing is a transient non-equilibrium process, during which phase change occurs with release of latent heat as liquid or fluid cools below freezing temperature due to ambient cooling conditions. When water or some water based-mixtures are cooled below freezing, the material changes from a liquid state to a solid state, and undergoes a significant expansion in volume, which is as much as 10% or more for water or water-based mixtures. When water freezes in a pipe or other confined spaces, its volume expands. Water that has frozen in confined spaces does more than simply clog the pipes and block flow. When freezing occurs in a confined space like a steel pipe, the ice will expand and exert extreme pressure which often leads to bursting of the pipe or separation of a joint and cause serious damage. This phenomenon is a common failure mode in hot-water heating systems and automotive cooling systems.

Ice forming in a confined space does not always cause cracking where ice blockage occurs. Rather, following a complete ice blockage in a confined space, continued freezing and expansion inside the confined space can cause water pressure to increase downstream, which could lead to pipe failure and/or cracking in these areas. Upstream from the ice blockage the water can retreat back towards its inlet source, and there is little pressure buildup to cause cracking. Relative to other liquids, water-based mixtures are preferred for use in liquid cooling systems due to advantages in thermal properties and health and safety concerns.

Liquid cooling systems for electronic devices are occasionally subjected to sub-freezing environments during shipping, storage, or in use. If the liquid freezes, the system must be designed to tolerate any volume expansion that would occur. Additives used to lower the freezing point, such as antifreeze, are potentially poisonous and flammable and can damage mechanical components, sensitive sensors, and electronics.

Therefore, to use pure water or substantially pure water in such a system, an apparatus for and method of controlling freezing nucleation and propagation is needed, such that the system can tolerate the volume expansion caused by freezing of the aforementioned fluid without damaging electronic components or affecting system performance.

SUMMARY OF THE INVENTION

The present invention protects components and pipes of a liquid cooling system from cracking related to an expansion of volume due to freezing of the fluid within the system. In particular, the present invention provides an apparatus for and method of controlling freezing nucleation and propagation in a liquid system having one or more components coupled and characterized by a plurality of surface area to volume ratios so that when freezing occurs, the fluid expands from an initial zone having a highest surface area to volume ratio in the direction of one or more zones having progressively decreasing surface area to volume ratios. Thus, the present invention manages and designs surface area to volume ratios of one or more components as well as regions within the components, including heat exchangers, inlet and outlet ports and tubular members, so that when freezing occurs, the volume expands in the direction that can accept the expanded volume.

In accordance with one embodiment of the present invention, an apparatus for controlling freezing nucleation and propagation in a liquid system is disclosed. The apparatus includes a heat exchanger having multiple zones characterized by surface area to volume ratio. The apparatus also includes means for initiating freezing of a fluid from an initial zone which results in volume expansion during freezing through the multiple zones having progressively lower surface area to volume ratios in the direction of a member having a final zone characterized by a final surface area to volume ratio. Alternatively, the heat exchanger can be replaced by any member in a liquid system.

In accordance with the present invention, the surface area to volume ratio of the final zone is preferably lower than the surface area to volume ratio of the initial zone. For a water based system the final zone can accommodate an expanded volume of at least 10% of all the liquid volume present in each zone, including the final zone, when the fluid freezes. For example, the final zone can be a tubular member. In one embodiment, the tubular member can have elasticity sufficient to expand outwardly to accommodate the volume expansion caused by the freezing of the fluid.

In the preferred embodiment, the initial zone is internal to a heat exchanger. The heat exchanger can include an inlet port extending through a first opening of the heat exchanger for conveying the fluid to a plurality of channels and passages and an outlet port extending through a second opening for discharging the fluid from the plurality of channels and passages. The plurality of channels and passages can be formed in porous copper foam. Alternatively, the plurality of channels and passages can be formed of microchannels. Alternatively, the plurality Multiple fluid pathways emanating from the initial zone may necessitate identification of multiple zones. In one embodiment, the apparatus includes a plurality of zones located between the initial and final zones, wherein a zone surface area to volume ratio is calculated for each zone. Preferably, the zone surface area to volume ratio of each zone progressively decreases from the initial zone in the direction of the final zone.

The apparatus can include one or more compressible objects coupled within the final zone wherein pressure exerted on the compressible object by the freezing fluid increases a volume of the final zone. The compressible objects are preferably confined within the final zone. The compressible objects can be made of one of the following: sponge, foam, air-filled bubbles, and balloons. Preferably, the sponge and foam are hydrophobic.

The apparatus can also include at least one air pocket disposed in the final zone wherein the air pocket accommodates the expansion by the freezing fluid. Alternatively, the apparatus can include at least one flexible object coupled to the final zone wherein pressure exerted on the flexible object by the freezing fluid increases a volume of the final zone. Preferably, the flexible object is secured within the final zone. The flexible object can be made of one of the following: rubber, plastic, and foam.

In accordance with another embodiment of the present invention, a method of controlling freezing nucleation and propagation in a liquid system is disclosed. The method comprises the steps of initiating freezing of fluid from an initial zone of a heat exchanger and characterized by an initial surface area to volume ratio; and directing the frozen fluid to a final zone which is a tubular member characterized by a final surface area to volume ratio.

DETAILED DESCRIPTION OF THE PREFERRED EMBODIMENT

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it should be noted that the present invention can be practiced without these specific details. In other instances, well known methods, procedures and components have not been described in detail as not to unnecessarily obscure aspects of the present invention.

Figure 1:
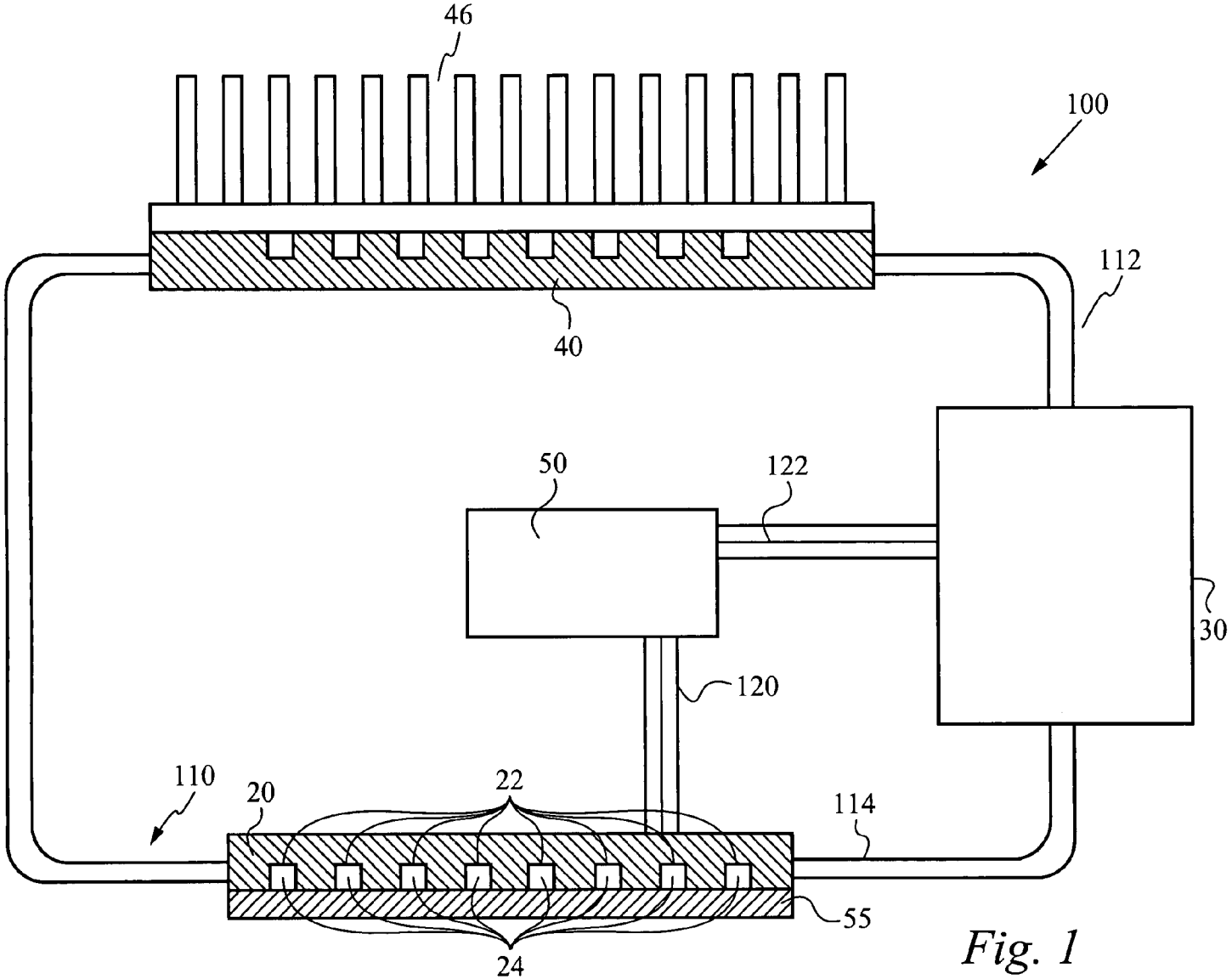
FIG. 1 illustrates one embodiment of a closed-loop fluid system for implementing embodiments of the present invention.

FIG. 1 shows a schematic diagram of a closed-loop fluid system 100 for implementing embodiments of the present invention. The system 100 includes a heat exchanger 20 attached to a heat producing device 55 (shown as an integrated circuit attached to a circuit board, but which could also be a circuit board or other heat producing device), a pump 30 for circulating fluid, a heat rejector 40, which can include a plurality of fins 46 for further assisting in conducting heat away from the system 100, and a controller 50 for a pump input voltage based on a temperature measured at the heat exchanger 20.

Fluid flows from an inlet of the pump 30, passes through a porous structure (not shown) within the pump 30 by electroosmotic forces, and exits through an outlet of the pump 30. While this embodiment uses an electroosmotic pump, it will be understood that the present invention can be implemented in a system using other types of pumps, such as a mechanical pump. The fluid travels through microchannels 24 of the heat exchanger 20, the heat rejector 40, and through tubing lengths 114, 112 and 110 before being returned to the inlet of the pump 30. A spreader (not shown) is preferably coupled between the heat producing device 55 and the microchannels 24. The controller 50 is understood to be an electronic circuit that may take input signals from thermometers in the heat exchanger 20, or from thermometers in the device 55 being cooled, through which signals are transmitted along signal lines 120. The controller 50, based upon the input signals may regulate flow through the pump 30 by applying signals to a power supply (not shown) associated with the pump 30 along signal lines 122 to achieve the desired performance. While this embodiment specifies a flow direction, it will be understood that the present invention can be implemented with the reverse flow direction.

As fluid temperature drops below freezing, ice starts to form. The rate at which ice forms depends on the rate at which the fluid cools, which depends on a surface area to volume ratio. Continued growth of ice in areas of the system 100 can lead to excessive fluid pressure. The resulting pressure can rupture or damage individual elements, such as the microchannels 24, including walls 22 of the microchannels 24, in the heat exchanger 20 and the tubular members 110, 112 and 114. As will be explained and understood in further detail below, these elements are designed in a way that tolerates expansion of the fluid during freezing.

Figure 2:
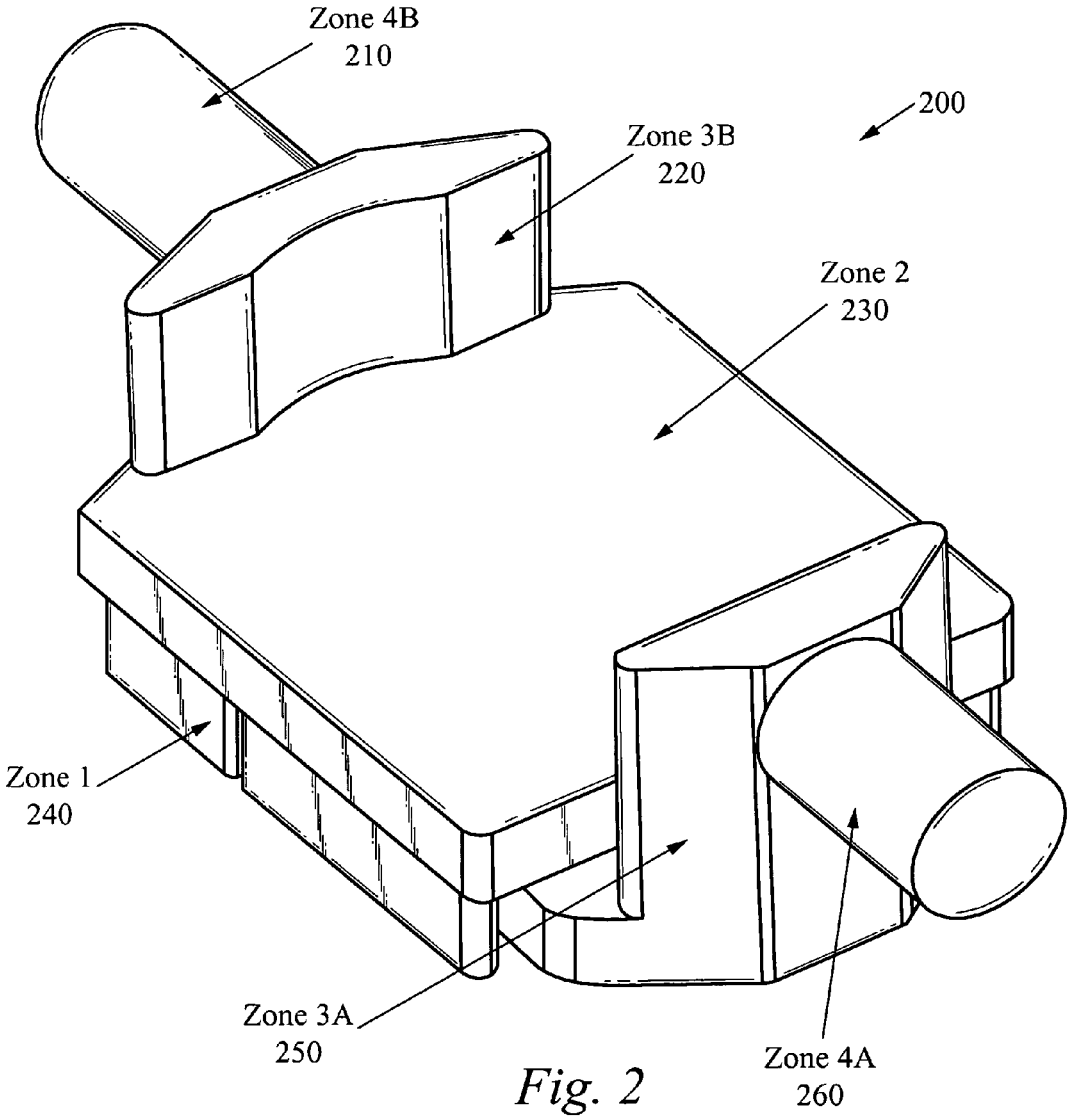
FIG. 2 illustrates one embodiment of a heat exchanger divided into logical zones characterized by surface area to volume ratios, in accordance with the present invention.

FIG. 2 illustrates one embodiment of a heat exchanger 200 divided into zones 1, 2, 3A and 3B and characterized by surface area to volume ratios. The heat exchanger 200 is coupled to tubular members 210 and 260 disposed in zone 4A and 4B, respectively, and also characterized by surface area to volume ratios. In this embodiment, zone 1 is the initial zone and the tubular members represent a final zone or zones. Zone 1 is preferably one or more microchannels (not shown) or a porous structure (not shown). Alternatively, Zone 1 can be one or more micropins (not shown). Surface areas are calculated for each zone, preferably based directly on model geometry. A zone can be constructed of one or more structures, such as copper foam, to have a desired surface area to volume ratio throughout the heat exchanger 200. Volumes are calculated for each zone, preferably based directly on model geometry. The surface to volume ratio of each zone is calculated by dividing the surface area of each zone by the volume of each zone. The resulting surface to volume ratio values of adjacent zones are compared. Freeze progression is deemed favorable when the surface area to volume ratio of the heat exchanger 200 progressively decreases outward from zone 1 to the tubular members at the onset of freezing. In particular, the surface area to volume ratio of zone 1 is relatively high and the surface area to volume ratios of the tubular members (zones 4A, 4B) are relatively low.

During freezing, the fluid expands from a zone having the highest surface area to volume ratio in the direction of one or more zones having progressively decreasing surface area to volume ratios. It will be appreciated that the heat exchanger 200, including the tubular members 210 and 260, can include many zones each with a different surface area to volume ratio. The zone surface area to volume ratio of adjacent zones progressively decreases from the heat exchanger 200 in the direction of the tubular members 210 and 260; the zone surface area to volume ratio decreases in the following order of zones: 1>2>3B>4B and 1>2>3A>4A.

In this embodiment, the tubular members 210 and 260 are designed to accommodate the necessary volume expansion.

The tubular members 210 and 260 preferably include compliant materials to accommodate an expanded volume of at least 10% when the fluid freezes. Preferably, the tubular members 210 and 260 have elasticity sufficient to expand outwardly to accommodate the volume expansion caused by the freezing of the fluid. Alternatively, the one or more compressible objects (not shown) can be coupled to the tubular member 210 and 260 wherein pressure exerted on the compressible object by the freezing fluid increases a volume of the tubular members 210 and 260. Preferably, the compressible objects (not shown) are confined within the tubular member and made of one of the following: sponge, foam, air-filled bubbles, sealed tubes and balloons. Other types of compressible objects can be used. The sponge and foam can be hydrophobic.

In another embodiment, at least one air pocket (not shown) can be disposed in the tubular members 210 and 260 wherein the air pocket (not shown) accommodates the expansion by the freezing fluid. Alternatively, at least one flexible object (not shown) is coupled to the tubular members 210 and 260 wherein pressure exerted on the flexible object (now shown) by the freezing fluid increases a volume of the tubular members 210 and 260. The flexible object (not shown) is preferably secured within the tubular member and made of one of the following: rubber, plastic, and foam. It will be appreciated that additional compliant materials may also be employed to withstand the expansion of freezing fluid.

This invention has been described in terms of specific embodiment in incorporating details to facilitate the understanding of the principles of construction and operation of the invention. Such reference herein to specific embodiment and the details thereof is not intended to limit the scope of the claims and hereto. It will be apparent to those of ordinary skill in the art that modifications can be made in the embodiment chosen for illustration without departing from the spirit and scope of the invention. Specifically, it will be apparent to one of ordinary skill in the art device of the present invention could be implemented in several different ways and the apparatus disclosed above is only illustrative of the before embodiment invention and is in no way limitation.

What is claimed is:

1. An apparatus for controlling freezing nucleation and propagation in a liquid system, comprising:

a. a member having an initial zone characterized by an initial surface area to volume ratio; and b. means for initiating freezing of a fluid from the initial zone to facilitate volume expansion during freezing in a direction that progresses through a series of subzones, each characterized by calculated surface area to volume ratio, to a final zone characterized by a final zone surface area to volume ratio, wherein the final zone surface area to volume ratio is lower than the initial surface area to volume ratio.

2. The apparatus of claim 1 wherein the member comprises a heat exchanger.

3. The apparatus of claim 2 wherein the heat exchanger includes an inlet port extending through a first opening of the heat exchanger for conveying the fluid to a plurality of channels and passages and an outlet port extending through a second opening for discharging the fluid from the plurality of channels and passages.

4. The apparatus of claim 3 wherein the heat exchanger includes multiple inlet ports and multiple outlet ports.

5. The apparatus of claim 1, wherein the final zone accommodates an expanded volume when the fluid freezes.

6. The apparatus of claim 1 wherein the calculated zone surface area to volume ratio of each subzone progressively decreases from the initial zone in the direction of the final zone.

7. The apparatus of claim 1 further including one or more compressible objects coupled to the final zone wherein pressure exerted on the compressible object by the freezing fluid increases a volume of the final zone.

8. The apparatus of claim 7 wherein the compressible objects are confined within the final zone.

9. The apparatus of claim 7 wherein the compressible objects are made of one of the following: sponge, foam, air-filled bubbles, sealed tubes and balloons.

10. The apparatus of claim 9 wherein the sponge is hydrophobic.

11. The apparatus of claim 9 wherein the foam is hydrophobic.

12. The apparatus of claim 1 further including at least one air pocket disposed in the final zone wherein the air pocket accommodates the expansion by the freezing fluid.

13. The apparatus of claim 1 further including at least one air pocket disposed along a freezing path in at least one of the zones and subzones.

14. A heat exchanger, comprising:

a. an initial zone characterized by a initial surface area to volume ratio; and b. means for initiating freezing of a fluid from the initial zone to accommodate volume expansion during freezing in the direction of a final zone characterized by a final zone surface area to volume ratio, wherein the final zone surface area to volume ratio is lower than the initial surface area to volume ratio.

15. The heat exchanger of claim 14 wherein the final zone accommodates an expanded volume when the fluid freezes.

16. The heat exchanger of claim 14 wherein the heat exchanger includes an inlet port extending through a first opening of the heat exchanger for conveying the fluid to a plurality of microstructures and an outlet port extending through a second opening for discharging the fluid from the plurality of channels and passages.

17. The heat exchanger of claim 16 wherein the heat exchanger includes multiple inlet ports and multiple outlet ports.

18. The heat exchanger of claim 14 wherein the final zone elasticity is sufficient to expand outwardly to accommodate the volume expansion caused by the freezing of the fluid.

19. The heat exchanger of claim 14 further including a plurality of subzones located between the initial zone and the final zone, wherein a zone surface area to volume ratio of each subzone progressively decreases from the initial zone in the direction of the final zone.

20. The heat exchanger of claim 19 wherein at least one of the subzones is constructed of a structure to obtain a predetermined surface area to volume ratio.

21. The heat exchanger of claim 20 wherein the structure is a copper foam.

22. The heat exchanger of claim 14 wherein at least one of the zones is constructed of a structure to obtain a predetermined surface area to volume ratio.

23. The heat exchanger of claim 22 wherein the structure is a copper foam.

24. The heat exchanger of claim 14 further including one or more compressible objects coupled to the tubular member wherein pressure exerted on the compressible object by the freezing fluid increases a volume of the final zone.

25. The heat exchanger of claim 24 wherein the compressible objects are made of one of the following: sponge, foam, air-filled bubbles, sealed tubes and balloons.

26. The heat exchanger of claim 25 wherein the sponge is hydrophobic.

27. The heat exchanger of claim 25 wherein the foam is hydrophobic.

28. The heat exchanger of claim 14 further including at least one air pocket disposed in the final zone wherein the air pocket accommodates the expansion by the freezing fluid.

29. The heat exchanger of claim 14 further including at least one air pocket disposed along a freezing path in at least one of the zones and subzones.

30. A heat exchanger, comprising:

a. an inlet port extending through a first opening of the heat exchanger for conveying a fluid to a plurality of channels and passages;

b. an outlet port extending through a second opening for discharging the fluid from the plurality of channels and passages; and c. means for initiating freezing from an initial zone of the heat exchanger characterized by an initial zone surface area to volume ratio to facilitate volume expansion during freezing in the direction of the inlet and outlet ports to a tubular member having a final zone characterized by a final zone surface area to volume ratio lower than the initial zone surface area to volume ratio.

31. The heat exchanger of claim 30 wherein the final zone elasticity is sufficient to expand outwardly to accommodate the volume expansion caused by the freezing of the fluid.

32. The heat exchanger of claim 30 further including a plurality of subzones located between the initial zone and the final zone, wherein a zone surface area to volume ratio of each subzone progressively decreases from the initial zone in the direction of the final zone.

33. The heat exchanger of claim 32 wherein at least one of the subzones is constructed of a structure to obtain a predetermined surface area to volume ratio.

34. The heat exchanger of claim 33 wherein the structure is a copper foam.

35. The heat exchanger of claim 30 wherein at least one of the zones is constructed of a structure to obtain a predetermined surface area to volume ratio.

36. The heat exchanger of claim 35 wherein the structure is a copper foam.

37. The heat exchanger of claim 30 wherein the heat exchanger includes multiple inlet ports and multiple outlet ports.

38. A method of controlling freezing nucleation and propagation in a liquid system, comprising the steps of:

a. initiating freezing of fluid from an initial zone of a heat exchanger and characterized by a an initial zone surface area to volume ratio; and b. directing the frozen fluid to a final zone characterized by a final, lower, surface area to volume ratio.

39. The method of claim 38 wherein the final zone accommodates an expanded volume when the fluid freezes.

40. The method of claim 38 wherein the heat exchanger includes an inlet port extending through a first opening of the heat exchanger for conveying the fluid to a plurality of channels and passages and an outlet port extending through a second opening for discharging the fluid from the plurality of channels and passages.

41. The method of claim 40 wherein the heat exchanger includes multiple inlet ports and multiple outlet ports.

42. The method of claim 38 wherein the final zone elasticity is sufficient to expand outwardly to accommodate the volume expansion caused by the freezing of the fluid.

43. The method of claim 38 wherein a plurality of subzones are located between the initial zone and the final zone, and wherein a zone surface area to volume ratio of each subzone progressively decreases from the initial zone in the direction of the final zone.

44. An apparatus for controlling freezing nucleation and propagation in a liquid system, comprising:

a. a member having an initial zone characterized by an initial surface area to volume ratio; and b. means for initiating freezing of a fluid from the initial zone to facilitate volume expansion during freezing in a direction that progresses through a series of subzones, each characterized by calculated surface area to volume ratio, to a final zone characterized by a final zone surface area to volume ratio, wherein at least one of the subzones is constructed of a copper foam to obtain a predetermined surface area to volume ratio.

45. The apparatus of claim 44 further including one or more compressible objects coupled to the final zone wherein pressure exerted on the compressible object by the freezing fluid increases a volume of the final zone.

46. The apparatus of claim 44 further including at least one air pocket disposed in the final zone wherein the air pocket accommodates the expansion by the freezing fluid.

47. The apparatus of claim 44 further including at least one air pocket disposed along a freezing path in at least one of the zones and subzones.

48. An apparatus for controlling freezing nucleation and propagation in a liquid system, comprising:

a. a member having an initial zone characterized by an initial surface area to volume ratio; and b. means for initiating freezing of a fluid from the initial zone to facilitate volume expansion during freezing in a direction that progresses through a series of subzones, each characterized by calculated surface area to volume ratio, to a final zone characterized by a final zone surface area to volume ratio, wherein the final zone alone expands to accommodate an expanded volume when the fluid freezes.

49. The apparatus of claim 48 wherein the compressible objects are confined within the final zone.

50. The apparatus of claim 49 wherein the sponge is hydrophobic.

51. The apparatus of claim 49 wherein the foam is hydrophobic.

52. The apparatus of claim 48 wherein the compressible objects are made of one of the following: sponge, foam, air-filled bubbles, sealed tubes and balloons.

* * * * *